United States Patent [19]

Matsumoto

[11] 4,430,532

[45] Feb. 7, 1984

[54] ELECTRONIC WATCH MULTI-CURCUIT PUSHBUTTON SWITCH

[75] Inventor: Masataka Matsumoto, Tokorozawa, Japan

[73] Assignee: Citizen Watch Co., Ltd., Tokyo, Japan

[21] Appl. No.: 357,475

[22] Filed: Mar. 12, 1982

[30] Foreign Application Priority Data

Apr. 14, 1981 [JP] Japan ..... 56-52648[U]
Apr. 23, 1981 [JP] Japan ..... 56-57912[U]

[51] Int. Cl.[3] ..... H01H 35/00; H01H 3/12; G04C 3/00

[52] U.S. Cl. ..... 200/52 R; 200/159 R; 368/187; 368/290; 368/308; 368/319; 368/320

[58] Field of Search ..... 200/52 R, 159 R, 159 A, 200/302, 340; 368/61, 69, 70, 88, 107, 108, 110, 187, 184, 185, 288–290, 320, 321, 188, 203, 204, 217, 223, 224, 225, 250, 265, 266, 306, 308, 319

[56] References Cited

U.S. PATENT DOCUMENTS

| | | | |
|---|---|---|---|
| 3,783,607 | 1/1974 | Feurer | 368/290 |
| 3,948,037 | 4/1976 | Carlone | 368/70 |
| 3,973,099 | 8/1976 | Morris, Sr. | 368/308 |
| 3,974,351 | 8/1976 | Solou et al. | 200/159 R |
| 4,007,347 | 2/1977 | Haber | 200/159 R |
| 4,031,348 | 6/1977 | Eberhardt | 200/159 R |
| 4,043,115 | 8/1977 | Bryceland | 200/159 R X |
| 4,092,821 | 6/1978 | Wirz | 368/187 X |
| 4,130,986 | 12/1978 | Ramet | 200/159 A |
| 4,152,564 | 5/1979 | Wirz | 200/159 R |
| 4,218,601 | 8/1980 | Saito | 200/159 R |
| 4,259,551 | 3/1981 | Ohtani et al. | 200/159 B X |
| 4,320,485 | 3/1982 | Baumgartner | 200/159 R X |

*Primary Examiner*—J. R. Scott
*Attorney, Agent, or Firm*—Koda and Androlia

[57] ABSTRACT

A pushbutton device comprises a pipe or tubular member for being affixed to a casing as of an electronic watch, a pushbutton body axially movably disposed in the pipe, resilient structure for returning the pushbutton body to an original position, structure for retaining the pushbutton body in the pipe, and a plurality of contacts selectively actuatable by the pushbutton body into and out of mutual electrical contact. Either the pushbutton body or the pipe has at least one step on its upper surface remote from the contacts to provide a plurality of stepped strokes of depressed movement of the pushbutton body with respect to the pipe for selective actuation of the contacts. The resilient structure may be a coil spring or a resilient leaf spring.

10 Claims, 14 Drawing Figures

ELECTRONIC WATCH MULTI-CURCUIT PUSHBUTTON SWITCH

BACKGROUND OF THE INVENTION

The present invention relates to a pushbutton device for use on electronic apparatus such as electronic watches, electronic calculators, or the like.

As shown in FIG. 1, a conventional pushbutton device for use on various small-size electronic apparatus such as electronic watches or electronic calculators includes a pipe or tubular body 2 affixed to a casing 1 and a pushbutton body 3 spring-biased in the direction to expose its head out of the pipe 2. The pushbutton device is actuated by depressing the pushbutton head with a fingertip until the head enters completely into the pipe 2. Where the pushbutton is small enough to be fully covered by the fingertip, the full stroke the pushbutton body 3 is pushed down until the fingertip hits an upper edge of the pipe 2 is generally utilized to give a single switching action. To provide such a pushbutton device with two mechanical switching actions, the pushbutton device would require the pushbutton body to move in two successive strokes respectively for the two switching movements of the pushbutton device. With such an arrangement, the operator would have to depress the pushbutton body under varying the distance of stroke with the fingertip so as to effect the different switching actions independently. The pushbutton device would therefore need sustained attention to operate properly and be infeasible from a practical standpoint.

Various pushbutton devices have been proposed and used which include a click mechanism for moving a pushbutton in distinct stepped strokes. The prior click mechanisms however are complex in structure with the results that the pushbutton devices incorporating the click mechanisms are complicated in construction and large in size. When the pushbutton is depressed with a stronger force than normally expected, the click mechanism also tends to allow the pushbutton body to move all the way down through the two strokes beyond the intermediate position in which the pushbutton is to be stopped at the end of the first stroke.

SUMMARY OF THE INVENTION

It is an object of the present invention to provide a pushbutton device which is composed of a relatively small number of parts to perform a plurality of stepwise switching actions.

Another object of the present invention is to provide a pushbutton device having a pushbutton body movable with a fingertip in a plurality of strokes without relying on a click mechanism.

According to the present invention, a pushbutton device comprises a pipe or tubular member adapted to be affixed to a casing, a pushbutton body axially movably disposed in the pipe, means for returning the pushbutton body to an original position, means for retaining the pushbutton body in the pipe, and a plurality of contacts actuatable by the pushbutton body into and out of contact with each other. Either the pushbutton body or the pipe has at least one step on its upper surface to provide a plurality of strokes of depressed movement of the pushbutton body with respect to the pipe.

The above and other objects, features and advantages of the present invention will become more apparent from the following description when taken in conjunction with the accompanying drawings in which certain preferred embodiments of the present invention are shown by way of illustrative example.

DESCRIPTION OF THE PREFERRED EMBODIMENTS

Figure 1:
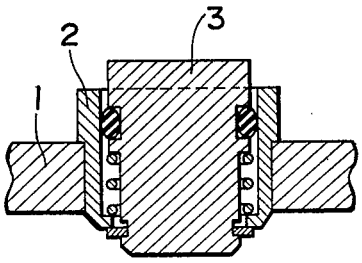
FIG.1 PRIOR ART
FIG. 1 is a cross-sectional view of a conventional pushbutton device.
Figure 2:
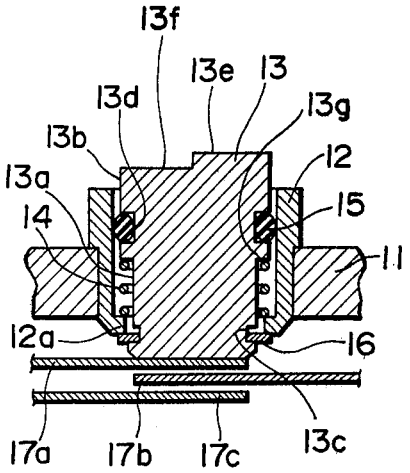
FIG. 2 is a cross-sectional view of a pushbutton device according to a first embodiment of the present invention.

FIG. 2 illustrates a pushbutton device according to a first embodiment of the present invention, the pushbutton device being mounted to a casing 11 such as of an electronic watch or an electronic calculator. The pushbutton device comprises a pipe or tubular member 12, a pushbutton body 13 axially movably disposed in the pipe 12, a coil spring 14 for returning the pushbutton body 13 to its original position, a watertight O ring 15 interposed between the pushbutton body 13 and the pipe 12, and a retaining E ring 16 for retaining the pushbutton body 13 in the pipe 12 against falling thereoff.

The casting 11 was a through hole 11*a* in which there is fitted the pipe 12 affixed to the casing 11. The pipe 12 has a radially inward flange 12*a* at a lower end of the pipe 12, the coil spring 14 being placed on the flange 12*a*. The pushbutton body 13 has a smaller-diameter lower portion 13*a* capable of passage through an inner periphery of the flange 12*a*, and a larger-diameter upper portion 13*b* having a diameter larger than the inside diameter of the flange 12*a*, but small enough to move axially through the remainder of the pipe 12. The smaller-diameter portion 13*a* has a groove 13*c* therearound in which the E ring 16 is fitted. The larger-diameter portion 13*b* has a groove 13*d* therearound in which the O ring 15 is fitted. The pushbutton body 13 has an upper surface remote from the E ring 16, which is stepped to provide a first upper surface section 13*e* and a second upper surface section 13*f*. In assembly, the pushbutton body 13 with the O ring 15 mounted in the groove 13*d* is inserted into the pipe 12 while the coil spring 14 disposed around the pushbutton body 13 and placed on the flange 12*a* of the pipe 12 is being compressed by a step or shoulder 13*g* defined between the smaller-diameter and larger-diameter portions 13*a*, 13*b*. When the groove 13*c* emerges out of the pipe 12 past the flange 12*a*, the E ring 16 is brought into fitting engagement in the groove 13*c*, whereupon the pushbutton body 13 is axially movably retained in the pipe 12. At this time, the O ring 15 fitted in the groove 13*d* is compressed against the inner peripheral surface of the pipe 12 so as to serve as a watertight seal for protection against passage of water along the boundary between the pipe 12 and the pushbutton body 13. The E ring 16 fitted in the groove 13*c* is engageable with a lower surface of the flange 12*a* to prevent the pushbutton body 13 from being pulled out of the pipe 12. Three switch contacts 17*a*, 17*b*, 17*c* are disposed in overlapping relation to one another and positioned below the pushbutton body 13. The contacts 17*a*, 17*b*, 17*c* are electrically connected respectively to electrical parts (not shown).

Figure 3:
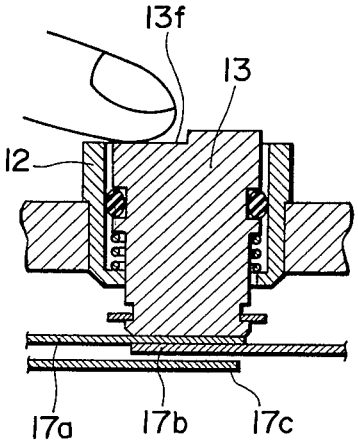
FIGS. 3 and 4 are cross-sectional views of the pushbutton device shown in FIG. 2, showing operations of the pushbutton device.
Figure 4:
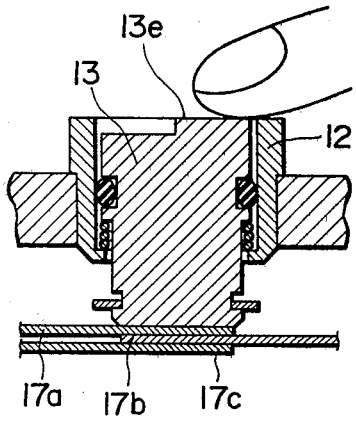

The pushbutton device thus constructed can be actuated as follows: When the second upper surface section 13*f* of the pushbutton 13 is depressed with a fingertip into alignment with the upper edge of the pipe 12, as illustrated in FIG. 3, the pushbutton body 13 depresses the first switch contact 17*a* into electrical contact with the second switch contact 17*b*. Such depressed movement of the pushbutton body 13 constitutes a first stroke of actuation of the pushbutton device. Upon release of a finger pressure, the pushbutton body 13 is returned upwardly to its original position under the resiliency of the coil spring 14. When the first upper surface section 13*e* is depressed until it aligns with the upper edge of the pipe 12 as shown in FIG. 4, the first, second and third switch contacts 17*a*, 17*b*, and 17*c* are caused by the pushbutton body 13 to make mutual electrical contact in a second stroke of actuation of the pushbutton device. When the fingertip is released, the pushbutton body 13 is spring-urged to its original position (FIG. 2).

Figure 5:
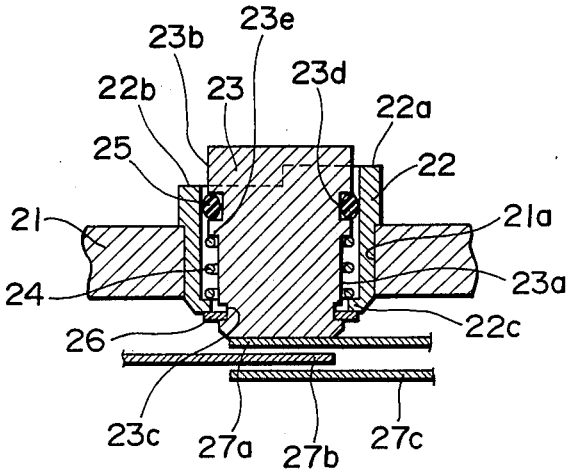
FIG. 5 is a cross-sectional view of a pushbutton device according to a second embodiment of the present invention.

According to a second embodiment shown in FIG. 5, a pushbutton device comprises a pipe 22 secured to a casing 21, a pushbutton body 23, a coil spring 24, an O ring 25, and an E ring 26. The casing 21 has a through hole 21*a* in which the pipe 22 is securely mounted. The pipe 22 has an upper edge stepped to provide a first upper surface section 22*a* and a second upper surface section 22*b*. The pipe 22 has on its lower end an annular flange 22*c* extending radially inwardly and supporting thereon the coil spring 24. The pushbutton 23 includes a smaller-diameter lower portion 23*a* dimensioned to be able to pass through the annular flange 22*c*, and a larger-diameter upper portion 23*b* which is of a diameter larger than the inside diameter of the annular flange 22*c*, but small enough to pass through the remainder of the pipe 22. The smaller-diameter portion 23*a* has a groove 23*c* extending therearound with the E ring 26 fitted therein, and the larger-diameter portion 23*b* has a groove 23*d* extending therearound with the O ring 25 fitted therein. To assemble the pushbutton device, the pushbutton body 23 with the O ring 25 mounted in the groove 23*d* is inserted into the pipe 22, during which time the coil spring 24 on the flange 22*c* of the pipe 22 is progressively compressed by a step or shoulder 23*e* defined between the smaller-diameter and larger-diameter portions 23*a*, 23*b*. When the groove 23*c* appears out of the pipe 22 beyond the flange 22*c*, the E ring 26 is fitted into the groove 23*c* to thereby retain the pushbutton body 23 axially movably in the pipe 22 against falling thereoff. The O ring 25 retained in the groove 23*d* is in compression against the inner peripheral surface of the pipe 22 to serve as a watertight seal. The E ring 26 in the groove 23*c* can engage with a lower edge of the flange 22*c* to prevent the pushbutton body 23 from being taken out of the pipe 22. The pushbutton body 23 overlies three switch contacts 27*a*, 27*b*, 27*c*.

Figure 7:
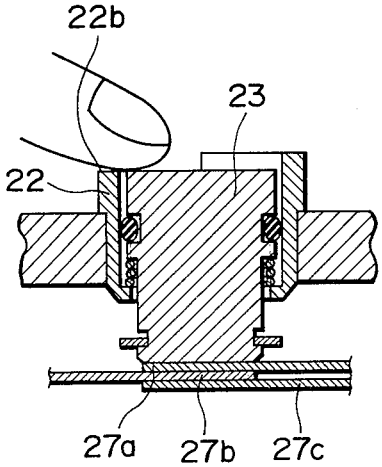
FIGS. 6 and 7 are cross-sectional views of the pushbutton device illustrated in FIG. 5, showing the way in which the pushbutton operates.
Figure 6:
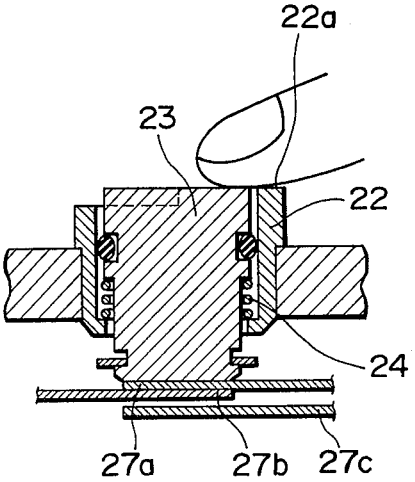

In operation, the pushbutton body 23 is depressed with a fingertip until its upper surface is lowered into line with the first upper surface section 22*a* of the pipe 22 as shown in FIG. 6, whereupon the first switch contact 26*a* is caused by the pushbutton body 23 to descend into electrical contact with the second switch contact 27*b*. The pushbutton device is thus actuated in a first stroke. Upon releasing the pushbutton body 23 of a fingertip pressure, the pushbutton body 23 is moved upwardly toward its original position under the force of the coil spring 24. The pushbutton device is actuated in its second stroke by depressing the pushbutton body 23 until its upper surface is held in alignment with the second upper surface section 22*b* of the pipe 22, as illustrated in FIG. 7, whereupon the first, second and third switch contacts 27*a*, 27*b*, 27*c* are electrically connected to one another. With the fingertip pressure removed, the pushbutton body 23 springs back to its original position.

Figure 8:
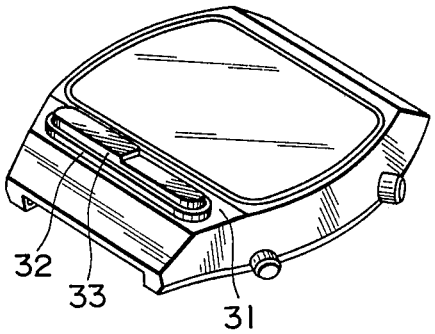
FIG. 8 is a perspective view of an electronic watch which incorporates a pushbutton device according to a third embodiment of the present invention.
Figure 9:
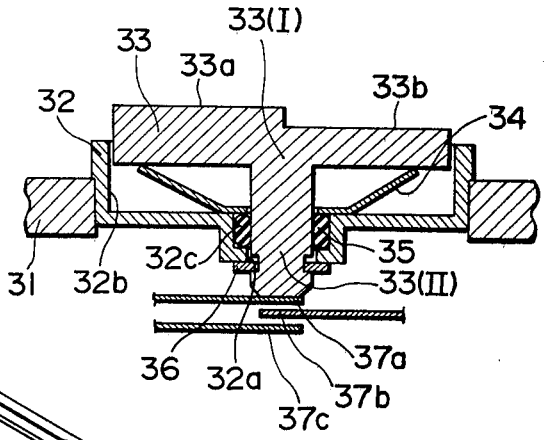
FIG. 9 is a longitudinal cross-sectional view of the pushbutton device shown in FIG. 8.

FIG. 8 and FIG. 9 show a pushbutton device according to a third embodiment of the present invention. As shown in FIG. 8, a pushbutton device is mounted on an electronic wrist watch, and comprises a pipe or tubular member 32 affixed to a casing 31 of the watch and a pushbutton body 33 housed in the pipe 32.

In FIG. 9, the pushbutton body 33 is composed of a head 33(I) and a shaft 33(II) integral therewith. The pipe 32 includes a retainer cylinder 32*a* supporting the shaft 33(II), a guide cylinder 32*b* by which the head 33(I) is guided, and a housing chamber 32*c* in which an O ring 35 is accommodated. A leaf spring 34 is disposed in the guide cylinder 32*b* for urging the pushbutton body 33 upwardly into its original position. The O ring 35 is compressed between the shaft 33(II) and the housing cylinder 32*c* so as to serve as a watertight seal against water passage. The head 33(I) is of an elongate structure which is stepped longitudinally to define a first upper surface section 33*a* and a second upper surface section 33*b*. The pushbutton device can be actuated in the same manner as that of the pushbutton of the first embodiment. However, the pushbutton device of FIG. 9 can be operated more easily because of its long configuration. Reference numeral 36 denotes an E ring for preventing the pushbutton body 33 from falling off the pipe 32, and reference numerals 37*a*, 37*b*, 37*c* denote switch contacts selectively actuatable by the pushbutton body 33.

Figure 10:
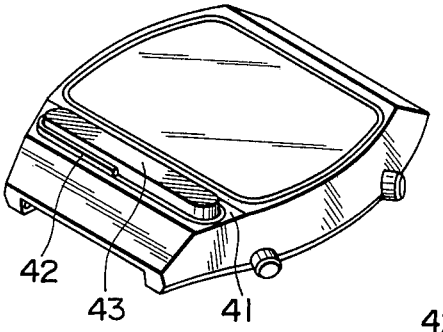
FIG. 10 is a perspective view of an electronic watch incorporating therein a pushbutton device according to a fourth embodiment of the present invention.
Figure 11:
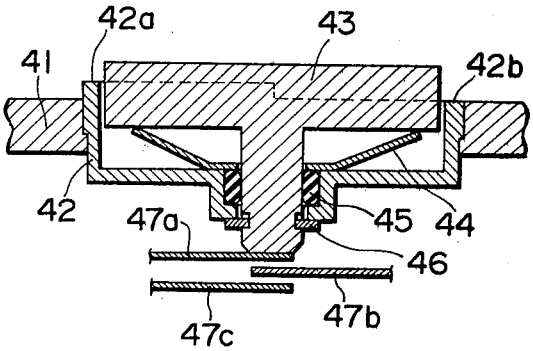
FIG. 11 is a longitudinal cross-sectional view of the pushbutton device shown in FIG. 10.

FIG. 10 illustrates an electronic wrist watch in which a pushbutton device according to a fourth embodiment is incorporated. The pushbutton device includes a pipe or tubular member 42 mounted on a casing 41 of the watch and a pushbutton body 43 disposed in the pipe 42. As shown in FIG. 11, the pipe 42 has its upper surface stepped to provide surface sections 42*a*, 42*b*. The pushbutton device includes a leaf spring 44 acting between the pushbutton body 43 and the pipe 42 to bias the pushbutton body 43 to its original position, an O ring 45 serving as a watertight seal, an E ring 46 for retaining the pushbutton body 43 against removal from the pipe 42, and a plurality of overlapping contacts 47*a*, 47*b*, 47*c* actuatable by the pushbutton body 43 for selective mutual electrical contact. The pushbutton device of the illustrated construction will operate in the same manner as that of the pushbutton device shown in FIG. 5.

Figure 12:
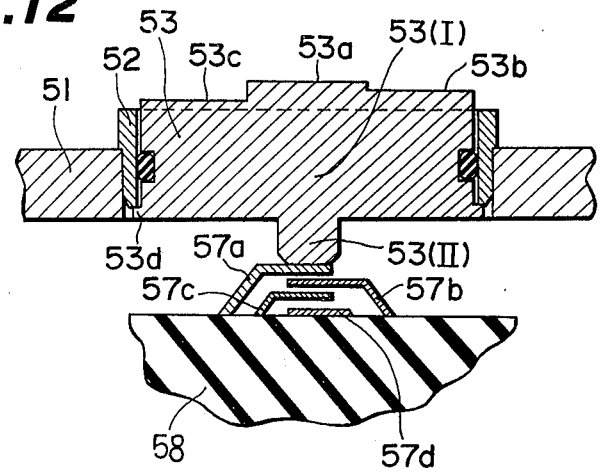
FIG. 12 is a cross-sectional view of a pushbutton device according to a fifth embodiment of the present invention.

According to a fifth embodiment of the present invention as shown in FIG. 12, a pushbutton body 53 is disposed in a pipe 52 with a watertight O ring interposed therebetween. The pushbutton body 53 has a head 53(I) with its upper surface stepped to define a first upper surface section 53*a*, a second upper surface section 53*b*, and a third upper surface section 53*c*. The pushbutton body 53 also includes a shaft 53(II) projecting downwardly and overlying a plurality of contacts 57*a*, 57*b*, 57*c*, 57*d* arranged in overlapping relation. The contacts 57*a* to 57*d* are fixedly mounted on a support 58 made of an insulating material and located below a casing 51 in spaced relation. The contact 57*a* is sufficiently resilient and strong to serve as a spring for returning the pushbutton body 53 to its original position. The pushbutton body 53 also includes a flange 53*d* extending radially outwardly and engageable with the pipe 52 to prevent the pushbutton body 53 from being taken out of the pipe 52. The contact 57*d* is fixedly secured to the support 58 to limit downward movement of the pushbutton body 53 such that the parts might not be stressed excessively or otherwise adversely affected if the pushbutton body 53 were depressed strongly. When the upper surface section 53*c* of the pushbutton body 53 is depressed into alignment with the upper edge of the pipe 52, the contact 57*a* is electrically connected to the contact 57*b*. Depression of the upper surface section 53*b* into line with the upper edge of the pipe 52 causes the contact 57*a* to be brought into electrical contact with the contacts 57*b*, 57*c*. The contact 57*a* is electrically connected to the other contacts 57*b* to 57*d* by depressing the upper surface section 53*a* of the pushbutton body 53 until the surface section 53*a* lies flush with the upper edge of the pipe 52.

Figure 13:
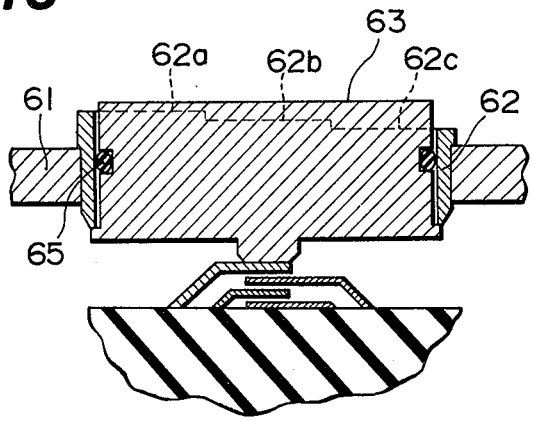
FIG. 13 is a cross-sectional view of a pushbutton device according to a sixth embodiment of the present invention.

In FIG. 13, a pushbutton device according to a sixth embodiment of the present invention comprises a pipe 62 secured to a casing 61 and a pushbutton body 63 housed in the pipe 62 with an O ring 65 interposed therebetween. The pipe 62 has its upper edge stepped into first, second and third upper surface sections 62*a*, 62*b*, 62*c*. The pushbutton device also has a plurality of contacts which are constructed and will be actuated in the same manner as that of the contacts shown in FIG. 12.

Figure 14:
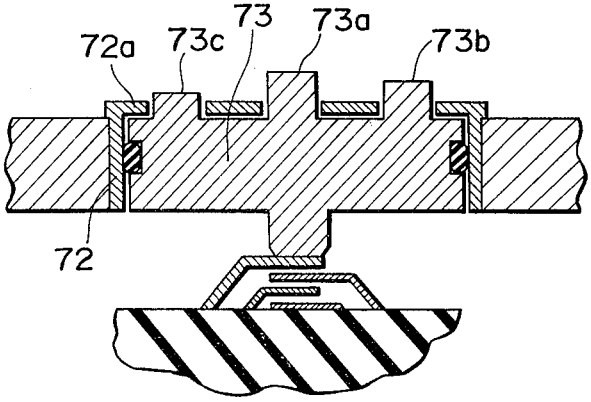
FIG. 14 is a cross-sectional view of a pushbutton device according to a seventh embodiment of the present invention.

FIG. 14 illustrates a pushbutton device in accordance with a seventh embodiment of the present invention. The pushbutton device has a pushbutton body 73 which has on its upper surface three projections or steps 73*a*, 73*b*, 73*c* which are different in height and spaced from each other. The pushbutton device also has a pipe 72 including an upper cover 72*a* lying over the pushbutton body 73 and having holes through which the steps 73*a* to 73*c* project upwardly. The upper cover 72*a* serves to retain the pushbutton body 73 in the pipe 72 against removal therefrom and also to separate the steps 73*a* to 73*c* for easy actuation thereof. The pushbutton device has a plurality of contacts which are of the same construction as that of the contacts illustrated in FIG. 12.

With the arrangements of the present invention, a pushbutton device can be actuated distinctly in successive stepped strokes for selective electrical connection of contacts without incorporating a complex mechanism therein. The pushbutton device according to the present invention is particularly suitable for use on small electrical devices such as electronic watches to facilitate switching operation thereof.

Although certain preferred embodiments of the invention have been shown and described in detail, it should be understood that various changes and modifications may be made therein without departing from the scope of the appended claims.

What is claimed is:

1. A pushbutton device for use on electronic apparatus comprising:

a pipe adapted to be affixed to a casing of said apparatus;

a pushbutton body axially movably disposed in said pipe;

means for returning said pushbutton body to an original position;

means for retaining said pushbutton body in said pipe; and a plurality of contacts successively actuatable into and out of mutual electrical contact in response to depressed movement of said pushbutton body away from said original position, said pushbutton body or said pipe having at least one step on a surface thereof remote from said contacts to provide a plurality of stepped strokes of depressed movement of said pushbutton body with respect to said pipe for selective actuation of said contacts.

2. A pushbutton device according to claim 1, wherein said returning means comprises a coil spring acting between said pushbutton body and said pipe.

3. A pushbutton device according to claim 1, wherein said returning means comprises a leaf spring acting between said pushbutton body and said pipe.

4. A pushbutton device according to claim 1, wherein said returning means comprises one of said plurality of contacts.

5. A pushbutton device according to claim 1, wherein said retaining means comprises a retaining ring secured to an end of said pushbutton body which is remote from said surface, and engageable with said pipe.

6. A pushbutton device according to claim 1 wherein said retaining means comprises a flange on an end of said pushbutton body which is remote from said surface, and engageable with said pipe.

7. A pushbutton device according to claim 1, wherein said retaining means comprises a cover on an end of said pipe which is adjacent to said surface of the pushbutton body, and engageable with said pushbutton body.

8. A pushbutton device according to claim 1, wherein said pushbutton comprises a head having said surface and guided by said pipe for movement of the pushbutton, and a shaft axially movably supported by said pipe.

9. A pushbutton device according to claim 1, further comprising a watertight seal ring interposed between said pipe and said pushbutton body.

10. A pushbutton device for use on an electronic watch comprising:

a pipe adapted to be affixed to a casing of said electronic watch;

a pushbutton body axially movably disposed in said pipe;

a watertight seal ring interposed between said pipe and said pushbutton body;

means for returning said pushbutton body to an original position;

means for retaining said pushbutton body in said pipe;

and a plurality of contacts actuatable by said pushbutton body into and out of mutual electrical contact, said pushbutton body or said pipe having at least one step on a surface thereof remote from said contacts to provide a plurality of strokes of depressed movement of said pushbutton body with respect to said pipe for selective actuation of said contacts.

* * * * *